US009109380B2

(12) United States Patent
Mittelbach et al.

(10) Patent No.: US 9,109,380 B2
(45) Date of Patent: Aug. 18, 2015

(54) MOTOR VEHICLE DOOR LOCK

(75) Inventors: Stephan Mittelbach, Velbert (DE); Rolf Siemensmeyer, Moers (DE); Dirk Eichel, Velbert (DE); Michael Strathmann, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 311 days.

(21) Appl. No.: 13/583,704

(22) PCT Filed: Jan. 14, 2011

(86) PCT No.: PCT/DE2011/000027

§ 371 (c)(1),
(2), (4) Date: Nov. 19, 2012

(87) PCT Pub. No.: WO2011/110142

PCT Pub. Date: Sep. 15, 2011

(65) Prior Publication Data

US 2013/0056997 A1 Mar. 7, 2013

(30) Foreign Application Priority Data

Mar. 10, 2010 (DE) ..... 10 2010 010 833

(51) Int. Cl.
*E05C 3/06* (2006.01)
*E05B 77/06* (2014.01)

(52) U.S. Cl.
CPC ..... *E05B 77/06* (2013.01)

(58) Field of Classification Search
CPC ..... E05B 77/06
USPC ..... 292/194, 198, 216, 201, DIG. 23, 292/DIG. 22
See application file for complete search history.

(56) References Cited

U.S. PATENT DOCUMENTS

| | | | | |
|---|---|---|---|---|
| 7,198,307 | B2 * | 4/2007 | Drysdale et al. | 292/216 |
| 2005/0012345 | A1 | 1/2005 | Saitoh | |
| 2009/0322105 | A1 * | 12/2009 | Lee et al. | 292/237 |

FOREIGN PATENT DOCUMENTS

| | | | |
|---|---|---|---|
| DE | 41 17 110 | | 12/1992 |
| DE | 195 11 651 | | 10/1995 |
| DE | 197 19 999 | A1 | 5/1997 |
| DE | 198 03 871 | | 8/1999 |
| EP | 1 371 799 | | 12/2003 |
| EP | 1518983 | A2 * | 3/2005 |
| JP | 2005120764 | A * | 5/2005 |
| WO | 2004/011749 | | 2/2004 |

OTHER PUBLICATIONS

International Search Report for corresponding patent application No. PCT/DE2011/000027 dated Jul. 1, 2011.

* cited by examiner

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

A motor vehicle door lock is provided with a catch with an actuating-lever mechanism which acts on the catch. There is also a locking lever which, together with the actuating lever, renders the actuating-lever mechanism inactive when accelerating forces of predetermined magnitude occur, for example in the event of a crash. The actuating lever and locking lever disable the actuating-lever mechanism mechanically, as a result of the accelerating forces occurring, by associated deflection. Following dissipation of the accelerating forces, the actuating lever and locking lever reconnect the actuating-lever mechanism.

12 Claims, 4 Drawing Sheets

MOTOR VEHICLE DOOR LOCK

The invention relates to a motor vehicle door lock which is provided with a catch with an actuating lever mechanism acting on the catch and a locking lever rendering the actuating lever mechanism inactive when accelerating forces of predetermined magnitude occur for example in the event of a crash.

The actuating lever mechanism can consist of one or several levers. Usually this actuating lever mechanism comprises at least one internal actuating lever and one external actuating lever. In most cases the actuating lever mechanism also includes a coupling lever and a release lever. The catch is in any case opened when an actuating lever mechanism is acted upon and a previously retained locking bolt is released. As a result, an associated motor vehicle door can be opened. For this purpose, a release lever generally acts upon a pawl interacting with a rotary latch as both components of the catch. The pawl is lifted off the rotary latch and the rotary latch and the locking bolt are released.

In case of a crash, high accelerating forces that can be a multiple of the gravitational acceleration (e.g. 5 g or more) are normally generated. In such an event considerable inertia forces act upon the respective motor vehicle door lock, causing the catch or the entire door lock to fail. It is also possible that the catch is unintentionally opened. The resulting generated accelerating forces produce in any case considerable risks for users of the vehicle. Consequently various measures, blocking the actuating lever mechanism in the event of the occurrence of the described accelerating forces, were introduced in the past. In most cases a so-called inertia lock is preferably used in the door handle, which under normal operating conditions is in a resting position and thus disengaged.

The generic state of the art as disclosed in DE 197 19 999 A1 provides a latch for opening means of a vehicle containing a lock. The lock blocks an opening lever when the described accelerating forces are exerted in the event of a crash. For this purpose, the lock and the opening lever are arranged diagonally to the swivel direction of the opening lever and are displaceable relative to each other. The opening lever enters the lock in the event of a relative movement caused by the accelerating forces. This aims to prevent unintentional opening in the event of a crash whilst at the same time simplifying the design. At the same time, the opening lever is blocked as before with the aid of the lock and generally the opening lever can also be permanently blocked.

The known measures have proven to be successful but they do not fully take into account the actual requirements. Although the blocking of the opening lever or of the entire actuating lever mechanism as disclosed by the prior art of DE 197 19 999 A1 prevents unintentional opening of the associated motor vehicle door in the event of a crash or also possibly hereafter, this is disadvantageous where occupants have to be freed immediately from the motor vehicle. This means that the known solutions for increasing mechanical safety in the latch in the event of a crash ensure correct blocking of the motor vehicle door latch and prevent unintentional opening but also impede direct access to the interior of the motor vehicle after a crash. The invention aims to remedy this situation.

The invention is based on the technical problem of developing such a motor vehicle door lock in such a way that whilst offering the same crash safety, it also offers the option of allowing the motor vehicle door lock to be opened immediately after the crash.

To solve this technical problem, a generic motor vehicle door lock is characterized in that the locking lever mechanically disables the actuating lever mechanism in the event of the accelerating forces being generated because of its associated design and closes it again once the accelerating forces have dissipated.

The invention thus makes use of a specially developed solution in which the actuating lever and the locking lever are designed in such a way that in the event of a crash, i.e. in case of an accident, both levers are deflected. This deflection is caused by the accelerating forces generated during a crash. With the deflection the locking lever also ensures that the actuating lever mechanism is mechanically disabled and blocked.

This mechanical disabling of the actuating lever mechanism ensures that the catch is or can, for instance, not be unintentionally released. In addition, malfunctioning of the actuating lever mechanism and/or a plastic deformation during an actual crash is mostly avoided as a result of the interlocking elements, whilst the actuating lever mechanism is still mechanically disabled. This is because the disabled continuous mechanical connection allows the individual elements of the actuating lever mechanism to move in relation to each other.

The actuating lever mechanism can, for instance, comprise an internal actuating lever, an external actuating lever, a coupling lever or a connecting lever and a release lever. Naturally the invention also covers embodiments in which the actuating lever mechanism only consists of a single lever directly providing a mechanical connection between an internal handle or an external handle and the catch. In this case the locking lever in a deflected state guarantees for instance that the internal handle (external handle) is separated from the one actuating lever in question.

During normal operation the actuating lever mechanism provides in any case a continuous mechanical connection from the internal handle and/or the external handle to the catch, so that the catch can be opened as usual if the internal lever and/or external lever are acted upon. In order to achieve this, the actuating lever mechanism usually acts upon the pawl lifting it off the rotary latch in its "closed" position.

As the rotary latch generally contains a rotary latch spring, this process ensures that the rotary latch—acted upon by the rotary latch spring—assumes its open position and releases the previously retained locking bolt. The motor vehicle door, mostly connected to the locking bolt, can then be opened.

Contrary to this normal operation, the actuating lever mechanism is mechanically disabled during a crash operation. This is ensured by the locking lever, which is deflected by the accelerating forces generated during a crash. The deflected locking lever disables the mechanical connection of the actuating lever mechanism. As a result, the activation of the internal handle and/or external handle does not (does no longer) act on the catch or the pawl as described, lifting it off the rotary latch. Any activation of the internal handle and/or external handle is thus without effect.

This prevents an inadvertent opening of the respective door during a crash, even if the internal handle and/or external handle are activated as a result of the accelerating forces. Passengers are consequently fully protected during a crash and the safety equipment such as side air bags and side impact protection, etc. usually provided today in motor vehicle doors, can be fully effective.

Once the accelerating forces dissipate, i.e. the crash has finished, the locking lever is no longer deflected. As a result, the locking lever assuming its former resting position again ensures that the actuating lever mechanism is closed—again. This means that once the accelerating forces have dissipated the mechanical connection from the internal handle and/or external handle to the catch is reinstated again. Manual activation of the internal handle and/or external handle will thus cause the catch to be opened—as usual. As a result, help for the occupants of a car can be provided immediately and without delay. There is also no or practically no malfunctioning.

The benefit of the motor vehicle door lock of the invention thus exceeds by far the benefit of previously known embodiments. The motor vehicle door lock or an associated motor vehicle door latch not only provide reliable protection for occupants during the crash but also resume their normal work and function after the accelerating forces associated with the crash have subsided. This allows occupants of the motor vehicle to be removed or assisted immediately. These are the main advantages of the invention.

In an advantageous embodiment, a return spring is assigned to the locking lever. This return spring primarily ensures that the locking lever returns to its normal position compared to the deflection position once the accelerating forces have subsided. During its deflection, the locking lever acts as a result of the accelerating forces and thus in the deflection position against said return spring. Following dissipation of the accelerating forces, the reset spring resets the locking lever. At the same time, the continuous mechanical connection of the actuating lever mechanism to the catch is reinstated, as already described above.

In order to provide a particular compact and cost-effective design, the locking lever is generally pivotably mounted on a second actuating lever. This second actuating lever is, in addition to the first actuating lever, also a part of the actuating lever mechanism. Usually this is the release lever. The first actuating lever is in most cases designed as a connecting lever or coupling lever.

Advantageously two stops are also assigned to the locking lever to limit its swivel movement. The first stop corresponds with the normal position of the locking lever and is provided on the first actuating lever. This first actuating lever is the connecting lever, and in any case not the actuating lever (release lever) on which the locking lever is pivotably mounted. A second stop is formed on the lock housing. This second stop corresponds to the deflection position of the locking lever.

In order to ensure that the locking lever continuously maintains the desired swivel function, the locking lever is released from the first stop in the event of a crash. During normal operation the locking lever is moved with the first actuating lever containing the first stop, e.g. the connecting lever. In this way any corrosion of an associated pivoting axis and seizing of the locking lever can be effectively prevented from the outset. This is due to the locking lever being moved during normal operation, i.e. during each activation of the internal handle and/or external handle together with the associated first actuating lever or connecting lever in case of the example. The locking lever and the connecting lever pivot together around the pivoting axis formed on the second actuating lever or release lever. This means that the first actuating lever and the locking lever are pivotably arranged on the common pivoting axis formed in turn on the further second actuating lever or release lever.

As already explained, considerable accelerating forces are generated during a crash, which are usually a multiple of the gravitational acceleration. These accelerating forces cause not only the first locking lever but also the first actuating lever to be deflected. As an accelerating force acting upon the locking lever also acts on the first actuating lever, the connecting lever in the example, as both levers are pivotably mounted on the common pivoting axis which in turn is formed on the second release lever or other further actuating lever and (can) move synchronously The design of the embodiment is such that it offers different thresholds for the generated accelerating forces for the first actuating lever on one hand and the locking lever on the other hand. The first actuating lever or connecting lever is indeed made of, for instance, die-cast zinc, whilst the locking lever is made of steel. In connection with the geometry of the lever, different thresholds can thus be defined for the generated accelerating forces, which need to be exceeded for the respective levers to be deflected.

In this context naturally not only the locking lever but also the questionable first actuating lever or connecting lever in the example, contain a return spring. Like the locking lever, also the first actuating lever or connecting lever must act against the counter force exerted by the return spring during its deflection. Only once this counter force has been overcome, is the desired deflection experienced by the levers in question (first actuating lever or connecting lever and/or locking lever).

The first actuating lever or connecting lever does thus—so to speak—carry along the locking lever. The actuating lever mechanism is consequently disabled as the connecting lever regularly provides the mechanical connection from the internal lever and/or external lever to the actuating lever or the catch. An end stop is allocated to the first actuating lever to ensure that the first actuating lever or connecting lever does not carry out a random and uncontrolled movement during its deflection caused by the accelerating forces. This end stop limits a deflection of the first actuating lever caused by the exerted accelerating forces. A second stop for the first actuating lever or connecting lever—such as for the locking lever—is not strictly required as the connecting lever interacts with the internal handle and/or external handle in its normal position. Only the deflection position of the first actuating lever or connecting lever must be limited, which is achieved by the aforementioned end stop.

The end stop generally contains an associated braking ramp in order to absorb energy and achieve a delay. This braking ramp may be designed as an incline or similar rising in height in the direction of deflection. Where the actuating lever or connecting lever is deflected as described as a result of the exerted accelerating forces, the levers in question are increasingly slowed down as they enter the incline or braking ramp.

The first actuating lever or connecting lever is indeed returned to its normal position when the accelerating forces dissipate. This is ensured by the return spring assigned to the actuating lever in question. Although its counterforce is initially overcome during the crash and application of the associated accelerating forces, it ensures that the first actuating lever returns to its normal position as the accelerating forces dissipate. This normal position means that the actuating lever mechanism is closed after the accelerating forces have been dissipated and creates once again a mechanical continuous connection from the internal handle or external handle up to the catch. The catch can thus be opened—again—as usual once the internal handle and/or external handle is manually operated. These are the main advantages. The object of the invention is also to provide a method for the operation of such a motor vehicle door lock as described in claim 15.

Below, the invention is explained in detail with reference to a drawing showing only one embodiment; in which.

Figure 1:
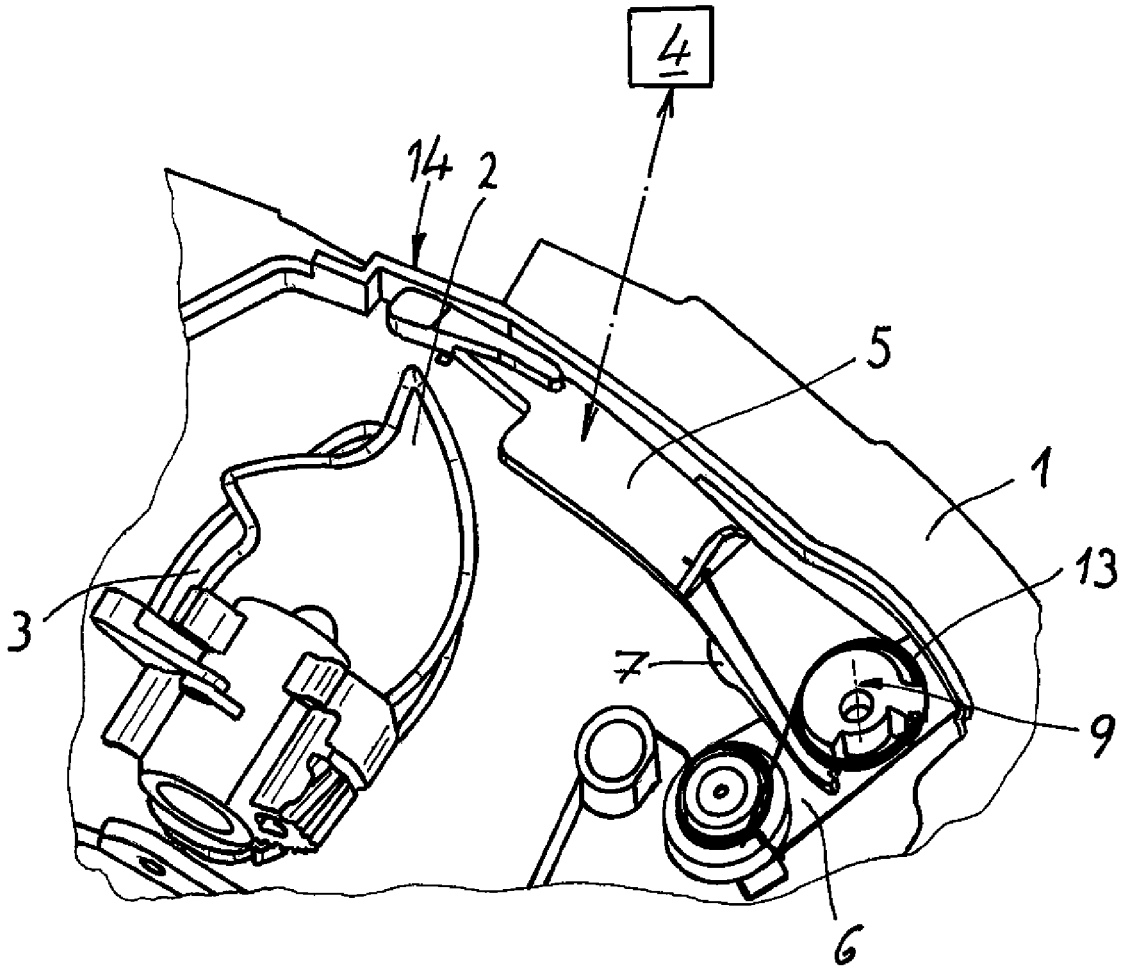
FIG. 1 represents a top view of the motor vehicle door lock of the invention

The figures show a motor vehicle door lock. The basic design of this lock comprises a housing 1 and a catch 2, 3 the housing 1 may be made of plastic and may be injection moulded. This is of course only an example and does not limit the scope of the invention. The catch 2, 3 comprises a rotary latch 2 and a pawl 3 interacting with the rotary latch 2. Together, the catch 2, 3 and the housing 1 define a motor vehicle door lock 1, 2, 3, containing further elements described below. The motor vehicle door latch 1, 2, 3 cooperates with a locking bolt (not shown) in the known manner. The motor vehicle door latch 1, 2, 3 may be arrange on or in a motor vehicle door (not explicitly shown), whilst the locking bolt is located at the associated motor vehicle body or vice versa.

An actuating lever mechanism 5, 6 acts upon the catch 2, 3. Furthermore a locking lever 7 is provided, which is shown in particular in FIGS. 2 and 3. The actuating lever mechanism 5, 6 is activated with the aid of an internal handle and/or external handle 4. A (manual) activation of the internal handle and/or external handle 4 causes the pawl 3 to be lifted off the rotary latch 2 in its closed state with the aid of the actuating lever mechanism 5, 6. As a result, the locking bolt retained before by the closed rotary latch 2 is released. The respective motor vehicle door can now be opened.

The locking lever 7 now ensures that the actuating lever mechanism 5, 6 is rendered ineffective or is moved into an ineffective state in the event of accelerating forces of a predetermined magnitude occurring. The locking lever 7 or the motor vehicle door latch 1, 2, 3 are consequently arranged in the motor vehicle in such a way that the locking lever 7 is deflected in y direction (longitudinal direction of vehicle) as described. Such accelerating forces generally occur in the event of a crash or as part of a crash sequence.

Figure 2:
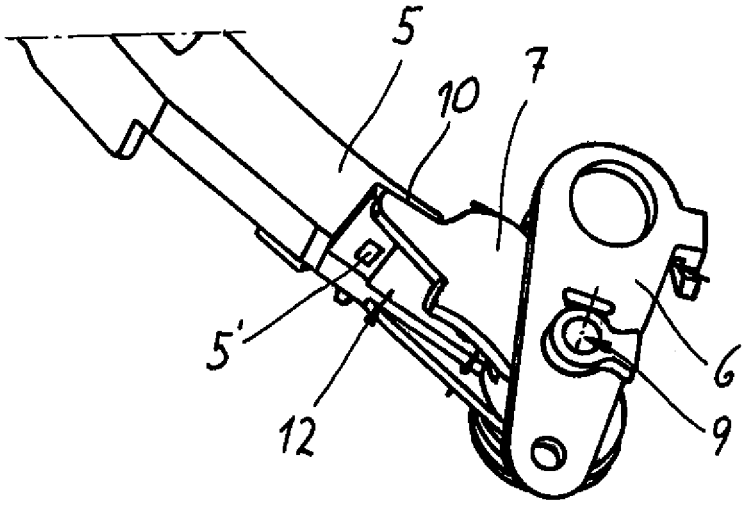
FIGS. 2 and 3 is a section of the rear view of FIG. 1.
Figure 3:
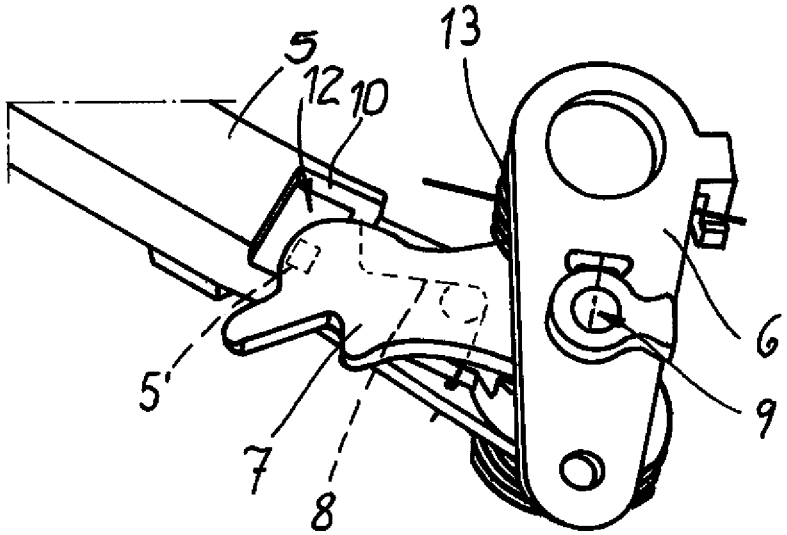

During such a situation, the locking lever 7 is moved out of its normal position shown in detail in FIG. 2 into its deflection position of FIG. 3 by the exerted accelerating forces. The rear view of FIG. 2 and the normal position shown in this illustration correspond with the front view of FIG. 4. The deflection position shown as a rear view in FIG. 3 belongs to the front view shown in FIG. 5.

Figure 4:
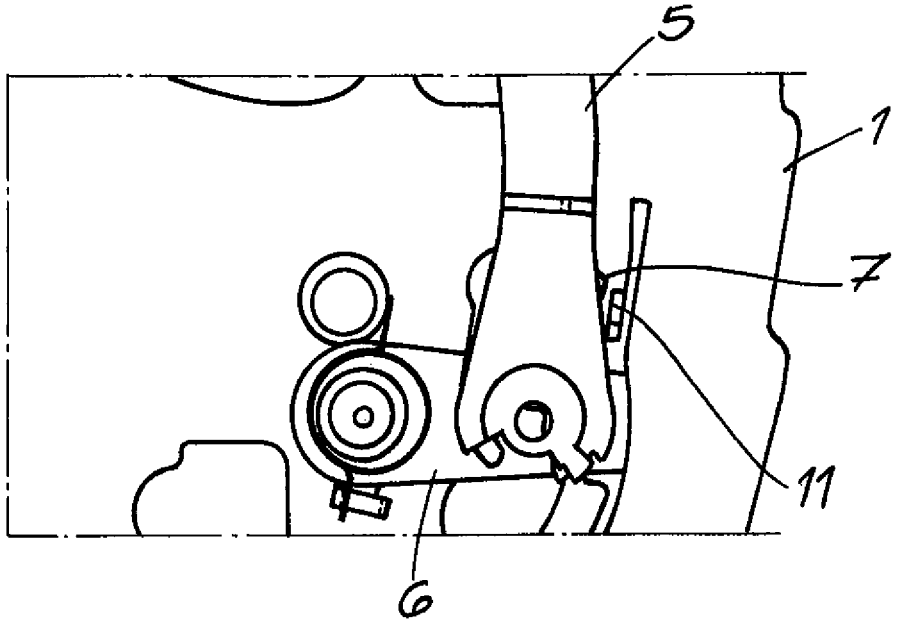
FIG. 4 shows a partial front view of the object of FIG. 1 corresponding with the rear view of FIG. 2
Figure 5:
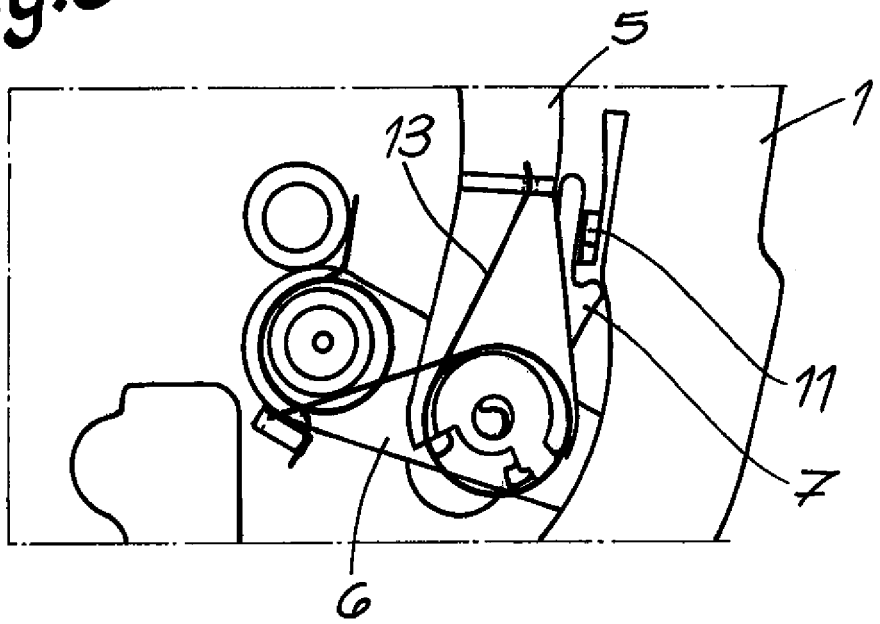
FIG. 5 shows the object of FIG. 4 in another functional position, belonging to the rear view shown in FIG. 3

When the locking lever 7 is in its normal position as shown in FIGS. 2 and 4, the actuating lever mechanism 5, 6 is closed and ensures a continuous mechanical connection from the internal handle/external handle 4 to the catch 2, 3 or via a release lever 6 to the rotary latch 3. An activation of the internal handle/external handle 4 thus ensures that the pawl 3 is lifted of the rotary latch 2 in its closed condition, as described. If the locking lever 7 is, on the other hand, acted upon by accelerating forces generated by a crash, the locking lever 7 moves from its normal position shown in FIGS. 2 and 4 into its deflection position as shown in FIGS. 3 and 5. At the same time, the locking lever 7 acts against an associated return spring 8.

When the accelerating forces are applied, the locking lever 7 assumes its deflection position as shown in FIGS. 3 and 5, whilst a connecting lever 5 being a further part of the actuating lever mechanism 6, is also deflected. The deflection of the connecting levers 5 causes the actuating lever mechanism 5, 6 to be mechanically disrupted, whilst the locking lever 7 also blocks the connecting lever 5 in the deflected position.

Following dissipation of the accelerating forces, the locking lever 7 is reset by the force of the return spring 8. The connecting lever 5 also assumes its normal position again as shown in FIGS. 2 and 4 in comparison to the deflection position shown in FIGS. 3 and 5. The actuating lever mechanism 5, 6 is then closed—again—and a continuous mechanical connection from the external handle/internal handle 4 up to the catch 2, 3 exists again.

During deflection or in the deflected position as shown in FIGS. 3 and 5, locking lever 7 thus acts against the associated return spring 8. Following dissipation of the accelerating forces, the return spring 8 ensures that the locking lever 7 assumes the normal position again as shown in FIGS. 2 and 4. At the same time, the mechanical connection from the actuating lever mechanism 5, 6 to the catch 2, 3 is reinstated.

The locking lever 7 is pivotably mounted on the further second actuating lever 6, in this case the release lever 6, whilst the connecting lever 5 represents the first actuating lever of the actuating lever mechanism 5, 6. For this purpose a common pivoting axis 9 is provided, projecting from or being defined by the respective release lever 6.

The first actuating lever or connecting lever 5 as well as the locking lever 7 are pivotably mounted on the common pivoting axis 9. Swivel movements of the locking lever 7 are restricted by two stops 10, 11. One stop, the first stop 10, is located at or on the first actuating lever or connecting lever 5, whilst the second stop 11 is arranged in or on the lock housing 1. This is easily achieved as the lock housing 1 is an injection moulded plastic part allowing the stop 11 in question to be easily added during production.

During normal operation, the locking lever 7 lies in its normal position against the first stop 10 on the connecting lever 5. For this purpose, the connecting lever 5 contains a recess 12 in which the locking lever 7 can be moved to and fro. As during normal operation, the locking lever 7 in its normal position as shown in FIGS. 2 and 4 rests against stop 10, the locking lever 7 is, during a combined pushing/swivelling movement of the connecting lever 5 moved along, activating the actuating lever 6 and then lifting the pawl 3 off the rotary latch 2. This means that during normal operation, the locking lever 7 and the connecting lever 5 move together around the pivoting axis 9 as a result of a rotation. This prevents any corrosion, seizing, etc. in comparison to the pivoting axis 9.

As soon as the locking lever 7 is moved from the normal operation or normal position into the deflection position as shown in FIG. 3 or FIG. 5, the stop 11 or second stop 11 ensures that the swivelling movement is slowed down. During its deflection as a result of the exerted accelerating forces, the locking lever 7 is carried along or operated by the connecting lever 5. The accelerating forces thus also ensure a deflection of the connecting levers 5, which is particularly apparent in the transition from FIG. 4 to FIG. 5. This deflection of the connecting levers 5 occurs also against the force of its own return spring 13.

The design is such that the first actuating lever or connecting lever 5 and the locking lever 7 are deflected taking into account the different thresholds for the exerted accelerating forces. In most cases, the accelerating force for deflecting the locking lever 7 is lower than that the force deflecting the first actuating lever or connecting lever 5.

Figure 6:
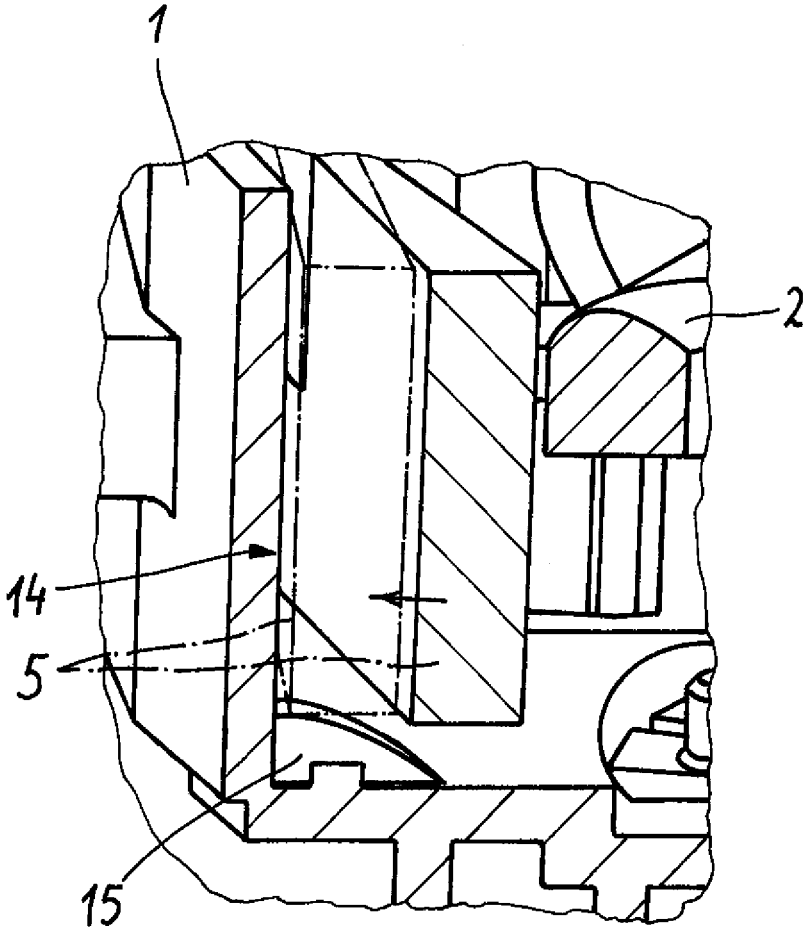
FIG. 6 shows a partial section through FIG. 1 in the area of the end stop for the first actuating lever.

In order to also limit the swivelling movement of the actuating lever or of the connecting lever 5, an end stop 14 is provided which is generally shown in FIG. 1 and in detail in sectional view FIG. 6. The latter also shows that a braking ramp 15 or an incline 15 is assigned to the end stop 14. As soon as the first actuating lever or connecting lever 5 moves towards the end stop 14 as a result of the exerted accelerating forces, the braking ramp or incline 15 ensures that the actuating lever or connecting lever 5 is slowed down.

Following dissipation of the accelerating forces, the respective return spring 8 for locking lever 7 and 13 for connecting lever 5 ensures that the locking lever 7 and the connecting lever 5 return to their normal position. The actuating lever mechanism 5, 6 is consequently closed and can at the end of a crash sequence lift and actuate the catch 2, 3 as usual with the aid of the external handle or internal handle 4.

The invention claimed is:

1. Motor vehicle door lock comprising:

a catch;

an actuating lever mechanism acting directly on the catch and including a first actuating lever and a second actuating lever; and a locking lever which renders the actuating lever mechanism inactive when an accelerating force of predetermined magnitude occurs, wherein in response to the accelerating force, the locking lever and the first actuating lever deflect from a normal position to a deflection position in which the locking lever blocks the first actuating lever to disable the actuating lever mechanism mechanically, and following dissipation of the accelerating force the locking lever and the first actuating lever automatically return to the normal position to reinstate the action of the actuating mechanism directly on the catch, and wherein the locking lever is pivotably mounted on the second actuating lever.

2. Motor vehicle door lock according to claim 1, wherein a return spring is assigned to the locking lever, against which the locking lever acts during deflection to the deflection position and which returns the locking lever to the normal position after dissipation of the accelerating force whilst, at the same time, reinstating a continuous mechanical connection from the actuating lever mechanism to the catch.

3. Motor vehicle door lock according to claim 1, wherein a first stop and a second stop for limiting swivel movement of the locking lever are assigned to the locking lever.

4. Motor vehicle door lock according to claim 3, wherein the first stop is arranged on the first actuating lever and the second stop is arranged on a lock housing.

5. Motor vehicle door lock according to claim 4, wherein in normal operation, the locking lever rests against the first stop and is moved along with the first actuating lever.

6. Motor vehicle door lock according to claim 4, wherein the locking lever is released from the first stop and rests against the second stop in response to the accelerating force.

7. Motor vehicle door lock according to claim 1, wherein the first actuating lever and the locking lever are jointly deflected by the accelerating force.

8. Motor vehicle door lock according to claim 1, wherein a threshold of accelerating force for deflecting the first actuating lever is different from a threshold of accelerating force for deflecting the locking lever.

9. Motor vehicle door lock according to claim 8, wherein the threshold of the accelerating force for deflecting the locking lever is lower than the threshold of the accelerating force for deflecting the first actuating lever.

10. Motor vehicle door lock according to claim 1, wherein an end stop is assigned to the first actuating lever, limiting deflection of the first actuating lever as a result of the occurring accelerating force.

11. Motor vehicle door lock according to claim 10, wherein the end stop contains a braking ramp.

12. Motor vehicle door lock comprising:

a catch;

an actuating lever mechanism acting directly on the catch and including a first actuating lever and a second actuating lever; and a locking lever which renders the actuating lever mechanism inactive when an accelerating force of predetermined magnitude occurs, wherein in response to the accelerating force, the locking lever and the first actuating lever deflect from a normal position to a deflection position in which the locking lever blocks the first actuating lever to disable the actuating lever mechanism mechanically, and following dissipation of the accelerating force the locking lever and the first actuating lever automatically return to the normal position to reinstate the action of the actuating mechanism directly on the catch, wherein the first actuating lever and the locking lever are pivotably arranged on a common pivoting axis, and wherein the pivoting axis is formed on a release lever as the second actuating lever for the catch.

* * * * *